United States Patent [19]

Andrier

[11] Patent Number: 4,505,620

[45] Date of Patent: Mar. 19, 1985

[54] FLEXIBLE OFFSHORE PLATFORM

[75] Inventor: Bernard Andrier, Louveciennes, France

[73] Assignees: Entrepose G.T.M. pour les Travaux Petroliers Maritimes et PM, Levallois-Per-per; Entrepose d'Equipements Mecaniques et Hydrauliques E.M.H., Saint Cloud; Societe Francaise d'Etudes d'Installations Siderurgiques SOFRESID, Montreuil, all of France

[21] Appl. No.: 545,153

[22] Filed: Oct. 25, 1983

[30] Foreign Application Priority Data

Sep. 22, 1983 [FR] France ..... 83 15045

[51] Int. Cl.[3] ..... E02D 21/00

[52] U.S. Cl. ..... 405/224; 405/195; 405/202

[58] Field of Search ..... 405/195-208, 405/224-227; 166/341-348, 350, 359, 367; 175/5-10

[56] References Cited

U.S. PATENT DOCUMENTS

| | | | |
|---|---|---|---|
| 2,058,402 | 10/1936 | Blum | 405/195 |
| 4,170,431 | 10/1979 | Wood | 405/195 X |
| 4,256,417 | 3/1981 | Bohannon | 405/203 X |
| 4,273,470 | 6/1981 | Blomsma et al. | 405/202 |
| 4,284,367 | 8/1981 | Tuson et al. | 405/202 |
| 4,363,567 | 12/1982 | Van der Graaf | 166/367 |
| 4,459,066 | 7/1984 | Van der Graaf | 166/367 |

*Primary Examiner*—Dennis L. Taylor

*Attorney, Agent, or Firm*—Amster, Rothstein and Engelberg

[57] ABSTRACT

The invention provides a flexible off shore platform comprising a base fixed to the sea bed by means of a foundation and supporting a flexible column extending over almost the whole height of the platform and at the top of which is located a stabilizer connected by a short column to the deck of the platform; the flexibility of the column allows a basic natural bending period greater than that of the largest waves and always greater than 25 seconds.

6 Claims, 3 Drawing Figures

FLEXIBLE OFFSHORE PLATFORM

BACKGROUND OF THE INVENTION

The exploitation of undersea hydrocarbon deposits is usually carried out from installations situated above sea level and supported by fixed platforms.

In zones where the depth of water is less than 300 m, the working loads are supported by relatively rigid platforms, than the periods shorter of the swell, in the order of 5 seconds maximum.

The construction of such platforms in water depths greater than 300 m leads to structures having prohibitive weights.

For great depths, structures which are flexible with respect to horizontal deformations, i.e. having natural bending periods greater than the period of the swell, have been envisaged and have also been installed.

The dynamic deformations of a structure are formed by the combination of different modes of deformation inherent to the structure, called natural modes. With each natural mode is associated a period called natural period of the structure. There are natural bending moves for the horizontal movements, twisting modes for rotation around a vertical axis and other modes which relate to vertical movements. The first and second natural bending modes correspond to the highest natural bending periods. For an exciting force with period equal to a natural period of the structure, the trend of the deformation will be very close to that of the corresponding mode and for an exciting force whose period is for example between the first two natural bending periods, the movement will be mainly a composition of the oscillations of the first two bending modes.

The dynamic behavior of a structure excited by a periodic force with a period shorter than the natural period of the structure, is such that the movement of the structure is in phase opposition with the exciting forces. Thus, the inertial forces which are equal to the product of the mass multiplied by the acceleration of the structure with a sign change, are in phase opposition with the exciting forces. The internal stresses induced in the structure, which are the resultants of the exciting forces and inertial forces, are then less than the exciting forces if the natural period of the structure is greater than the exciting periods and sufficiently removed therefrom, for example a natural period in the order of twice that on the exciting periods.

Among the structures which have been contemplated and even installed, are oscillating platforms and guyed platforms.

These platforms are made sufficiently flexible by incorporating into the structure a very flexible element, even including a hinged connection (French Pat. No. 82 12775 of July 22, 1982). In all cases the flexible element is localized. It then occurs that this element can only transmit extremely limited stresses in so far as bending and twisting are concerned.

The reaction forces with respect to the bending induced by the horizontal loads generated by the swell, the current and the wind reaction are provided either by a buoyancy reserve or by guys; the reaction forces due to the structure itself remain small.

The twisting loads which cannot be absorbed by the structure, taking into account the "flexible section", must be absorbed either by guys or by other elements specially designed for this purpose.

The localization of the flexible zone implies considerable deformations in the area of this zone. These deformations are not generally compatible with what is admissible for well conductor pipes and are therefore the cause of difficulties in fixing these offshore pipes.

SUMMARY OF THE INVENTION

The flexible platform of the invention, comprised of a foundation on the sea-bed, preferably composed of piles driven into the ground, a base fixed to the foundation, a flexible column extending over more than half the total height of the platform, a stabilizer which may be composed of immersed floats fixed to the top of the flexible column, and a column connecting this stabilizer to the deck of the platform, is characterized in that the distribution of the masses and the flexibility of the column are such that the basic natural bending period is greater than that of the largest waves and always greater than 25 seconds.

The flexible column by itself is capable of withstanding the internal bending stresses generated by the horizontal environmental forces, for these internal stresses are much smaller than the forces applied. This comes from the fact that the natural period of the first bending mode of the structure is much higher than the period of the waves.

The structure of the platform is flexible over the major part of its length. This allows both the first natural bending period to be raised and, with the flexibility being distributed, deformations to be compatible with what is admissible for well and facilitates supporting them.

Furthermore, the proposed structure has a stabilizer situated approximately at three quarters of the height of the platform, measured from the sea bed. The height of the platform, measured from the sea bed. The essential function of this element is to add a great mass both natural mass and water mass. This mass at a given position allows the natural period of the first bending mode to be raised and the natural period of the second bending mode to be reduced.

This stabilizer may be used as a buoyancy reserve compensating for the weight of the superstructures so as to avoid collapse of the lower part of the structure and so as to counterbalance the bending moment induced by the movement of the deck.

The platform of the invention may be broken down in the following way: foundation, base, lower column, stabilizer, upper column, deck.

The foundation will be preferably provided by piles driven into the sea-bed.

The base, which serves as a connection between the foundation and the rest of the structure and facilitates the installation of the piles, may be a relatively rigid structure. This base may be ballasted so that the piles remain under compression.

The lower column is the portion between the base and the stabilizer. It forms the major part of the structure and may be constructed from a lattice steelwork. This lattice steelwork provides both flexibility of the structure and the strength capability of the column. The dimensions of this lattice are such as to provide support for the well conductor pipes. These well conductor pipes will be placed either inside the structure or at the periphery, but as symmetrically as possible so as to reduce as much as possible the twisting stresses generated by the swell and the current. A metal or concrete shaft may possibly replace the metal lattice for constructing the lower column.

The stabilizer is placed approximately at a height with respect to the bottom equal to three quarters of the height of the platform. If this element serves as a buoyancy reserve, it will be formed from one or more floats. These floats will be compartmented and possibly filled with a product to minimize the consequences of a leak.

The stabilizer may include a shell, not necessarily closed, containing a large quantity of water.

The upper column is the portion of the structure situated above the stabilizer. It supports the deck and is under compression. The structure of the invention has advantages with respect to other flexible platforms The buoyancy reserve is reduced with respect to platforms in which practically the whole of the reaction forces results from the action of the float or floats. Compared with this latter type of platform, the safety of the structure is increased in the case of damage to these floats. The proposed platform requires no guys. This platform resolves the twisting problems in a more satisfactory way.

BRIEF DESCRIPTION OF THE DRAWINGS

One embodiment of the platform of the invention will now be described with reference to the accompanying drawings in which.

DESCRIPTION OF THE PREFERRED EMBODIMENT

Figure 1:
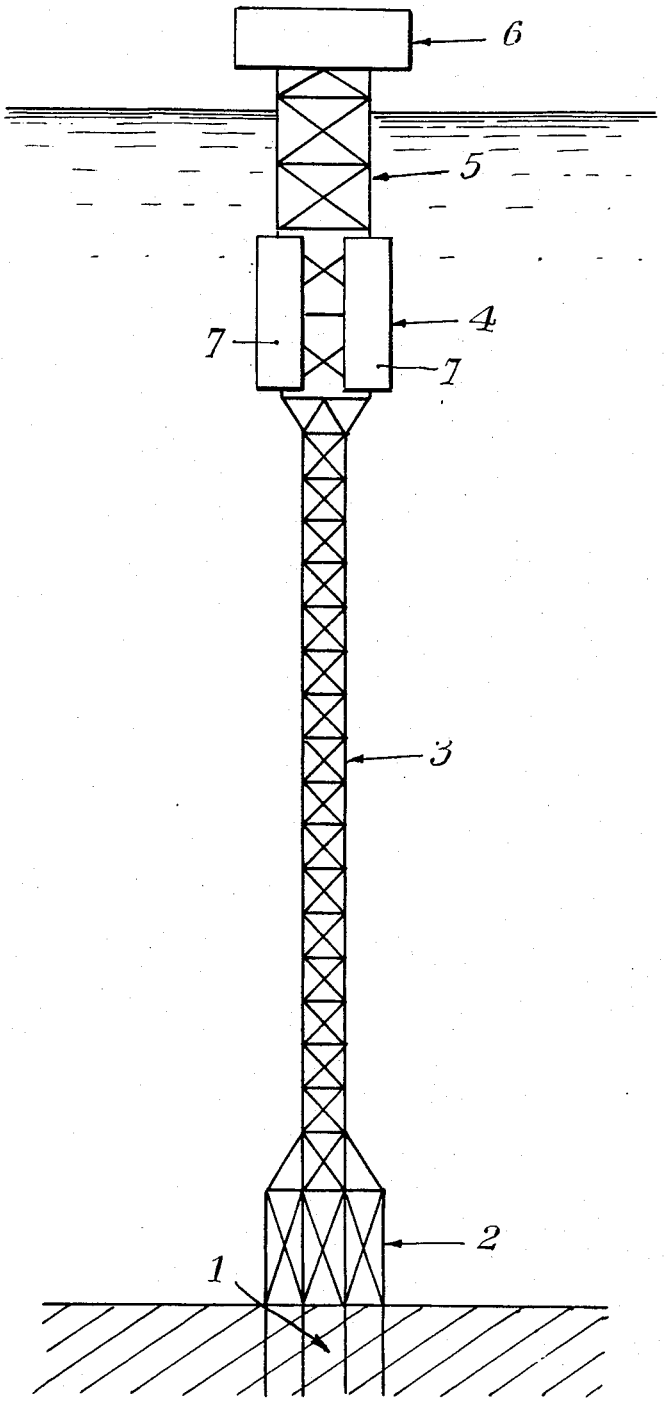
FIG. 1 is an elevational view of a so-called "reed" platform of a height of the order of 400 m.

The base 2 of the column is made from a rigid lattice steel work fixed to foundations 1 formed by driven "skirt piles" calculated for withstanding the tensile loads induced by the moments due to the swell. A base ballast may be provided for giving the structure a positive apparent weight.

Column 3 is a metal lattice of square section with four frame upright-members.

This column is connected at its upper part to a stabilizer 4 formed by several floats 7. Because of the permanent pull resulting from the action of the stabilizer, the flexible column structure may be designed having a very low weight.

The depth of this stabilizer results from a compromise between its weight which increases with the hydrostatic pressure and the force of the swell which decreases when the depth increases.

The shape of the floats of this stabilizer is determined by the condition of minimizing the horizontal wave forces and the fluctuations of the vertical forces.

The gravitational working loads on deck 6 are transmitted to stabilizer 4 by a short column 5.

Figure 2:
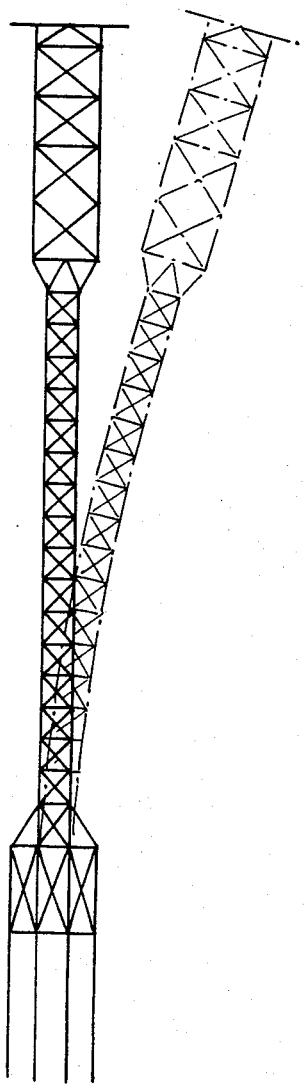
FIGS. 2 and 3 show the modes of deformation of the column for the natural periods of respectively 35*s* and 4*s*.
Figure 3:
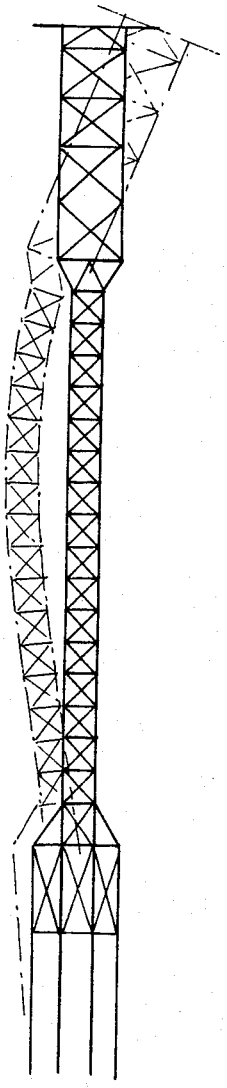

FIG. 2 shows one mode of behavior of the platform for a period of 35 seconds and FIG. 3 a mode for a beat period of 4 seconds natural.

Calculations have been made for a platform with a pay load of 20 000 T, having a total height of 445 meters, allowing 20 m for the deck, 59 m for the square lattice structure, 51 ml of stabilizer comprising four floats of a diameter of 15 m, a flexible square lattice column of 15 m and a base of 40 m.

The maximum amplitude of the movements of the platform were ±5 m with a maximum acceleration of the deck of 0.08 g.

What is claimed is:

1. A flexible offshore platform comprising a foundation which fixes the platform on the sea-bed, a flexible column fixed to said foundation extending over more than half of the total height of the platform, a stabilizer fixed to the top of the flexible column, a deck and a second column connecting the stabilizer to the deck, the stabilizer being positioned to be immersed in the water and entraining a given mass of water, the mass formed by the mass of the stabilizer and the mass of water entrained by the stabilizer providing a stabilizing effect for the platform, and wherein the platform structure itself has a rigidity able to generate reaction stresses which resist actions due to waves, wind and current.

2. The platform as claimed in claim 1, wherein the stabilizer includes a buoyancy reserve compensating for the weight of the deck.

3. The platform as claimed in claim 1, wherein the stabilizer comprises an open structure which contains a large quantity of water which contributes to the stabilizing effect.

4. The platform as claimed in claim 1, wherein the stabilizer comprises a closed buoyant structure.

5. The platform as claimed in claim 1, wherein the flexibility of the column and the distribution of the masses of the deck, of the column, of the stabilizer and the masses of water entrained by the stabilizer, are such that the basic natural bending period of the platform is greater than that of the largest waves and always greater than 25 seconds.

6. The platform as claimed in claim 1, wherein the flexibility of the column and the distribution of the masses of the deck, of the column, of the stabilizer and the masses of water entrained by the stabilizer are such that the natural period of the second bending mode of vibration of the platform is small compared to that of the largest waves and always less than 10 seconds.

* * * * *

UNITED STATES PATENT AND TRADEMARK OFFICE

CERTIFICATE OF CORRECTION

PATENT NO. : B1 4,505,620

DATED : March 19, 1985

INVENTOR(S) : Bernard Andrier

It is certified that error appears in the above-identified patent and that said Letters Patent is hereby corrected as shown below:

ON TITLE PAGE: Item [73]

Delete the designation of the Assignees and add

--Entrepose G.T.M. pour les Travaux Petroliers Maritimes ETPM, Levallois-Perret; Entrepose d'Equipements Mecaniques et Hydrauliques E.M.H., Saint Cloud; Societe Francaise d'Etudes d'Installations Siderurgiques SOFRESID, Montreuil, all of France--

Signed and Sealed this

Twenty-eighth Day of April, 1992

*Attest:*

*Attesting Officer*

HARRY F. MANBECK, JR.

*Commissioner of Patents and Trademarks*

REEXAMINATION CERTIFICATE (1190th)

United States Patent [19]

Andrier

[11] B1 4,505,620

[45] Certificate Issued Jan. 16, 1990

[54] FLEXIBLE OFFSHORE PLATFORM

[75] Inventor: Bernard Andrier, Louveciennes, France

[73] Assignee: Entropose GTM pour les Petroliers Maritimes ETPM, Montreuil, France

Reexamination Request:
No. 90/001,435, Feb. 11, 1988
No. 90/001,351, Oct. 9, 1987

Reexamination Certificate for:

| | |
|---|---|
| Patent No.: | **4,505,620** |
| Issued: | **Mar. 19, 1985** |
| Appl. No.: | **545,153** |
| Filed: | **Oct. 25, 1983** |

[30] Foreign Application Priority Data

Sep. 22, 1983 [FR] France ..... 8315045

[51] Int. Cl.[4] ..... E02D 21/00

[52] U.S. Cl. ..... 405/224; 405/195; 405/202

[56] References Cited

U.S. PATENT DOCUMENTS

| | | | |
|---|---|---|---|
| 3,224,401 | 12/1965 | Kobus | 114/265 |
| 3,369,511 | 2/1968 | German | 405/205 X |
| 3,407,766 | 10/1968 | Bergman | 114/264 |
| 3,407,767 | 10/1968 | McClintock et al. | 114/264 X |
| 3,460,501 | 8/1969 | Silverman | 114/264 |
| 3,500,783 | 3/1970 | Johnson et al. | 114/264 |
| 3,916,633 | 11/1975 | Lovie et al. | 405/203 |
| 4,117,690 | 10/1978 | Besse | 405/227 |
| 4,169,424 | 10/1979 | Newby et al. | 114/265 |
| 4,234,270 | 11/1980 | Gjerde et al. | 405/202 |
| 4,335,520 | 6/1982 | Wilson | 405/202 X |
| 4,543,014 | 9/1985 | Brandi et al. | 405/207 |

FOREIGN PATENT DOCUMENTS

| | | |
|---|---|---|
| 1418802 | 10/1965 | France . |
| 1557424 | 12/1979 | United Kingdom . |
| 2102482A | 2/1983 | United Kingdom . |
| 2123883A | 2/1984 | United Kingdom . |

OTHER PUBLICATIONS

Aker Engineering A/S–Monopile–Deepwater Offshore Loading Terminal–published 3/82.

C. G. Doris brochure, published 3/82.

Deep Offshore Technology Conference (Oct. 19–22, 1981), Mallorca, Spain, Proceedings, vol. 1, Deepwater Exploration, pp. 168–174.

C. G. Doris–Final Report–Deep Water Gravity Tower, vol. 1, selected pages.

*Primary Examiner*—Dennis L. Taylor

[57] ABSTRACT

The invention provides a flexible off shore platform comprising a base fixed to the sea bed by means of a foundation and supporting a flexible column extending over almost the whole height of the platform and at the top of which is located a stabilizer connected by a short column to the deck of the platform; the flexibility of the column allows a basic natural bending period greater than that of the largest waves and always greater than 25 seconds.

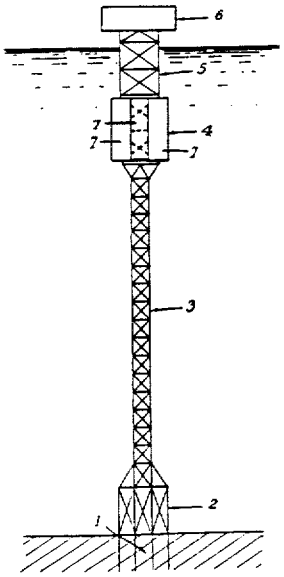

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 33 to 41:

Furthermore, the proposed structure has a stablizer situated approximately at three quarters of the height of the platform, measured from the sea bed. [The height of the platform, measured from the sea bed.] The essential function of this element is to add a great mass both natural mass and water mass. This mass at a given position allows the natural period of the first bending mode to be raised and the natural period of the second bending mode to be reduced.

Column 4, between lines 3 and 4: *The stablizer may include a shell, not necessarily closed, containing a large quantity of water.*

The drawing figures have been changed as follows: to indicate another spaced pair of parallel floats 7

AS A RESULT OF REEXAMINATION, IT HAS BEEN DETERMINED THAT:

Claim 3 is cancelled.

Claim 1 is determined to be patentable as amended.

Claims 2 and 4–6, dependent on an amended claim, are determined to be patentable.

1. A flexible offshore platform comprising a foundation which fixes the platform on the sea-bed, a flexible column fixed to said foundation extending over more than half of the total height of the platform, a stabilizer fixed to the top of the flexible column, a deck and a second column connecting the stabilizer to the deck, the stabilizer being positioned to be immersed in the water and entraining a given mass of water, the mass formed by the mass of the stabilizer and the mass of water entrained by the stabilizer providing a stabilizing effect for the platform, *the stabilizer comprising at least one open shell which entrains a large quantity of water which contributes to the stabilizing effect,* and wherein the platform structure itself has a rigidity able to generate reaction stresses which resist actions due to waves, wind and current.

* * * * *